United States Patent [19]

Stamper

[11] Patent Number: 4,684,076

[45] Date of Patent: Aug. 4, 1987

[54] RETRACTABLE CLOTHESLINE DEVICE

[75] Inventor: James F. Stamper, Nashville, Ind.

[73] Assignee: Lear Siegler, Inc., Seymour, Ind.

[21] Appl. No.: 879,286

[22] Filed: Aug. 14, 1986

Related U.S. Application Data

[63] Continuation of Ser. No. 742,031, Jun. 6, 1985, abandoned.

[51] Int. Cl.[4] ..... B65H 75/38; B65H 75/48

[52] U.S. Cl. ..... 242/100.1; 242/107.13; 242/107.3

[58] Field of Search ..... 242/100, 100.1, 100.2, 242/107.1, 107.11, 107.13, 96, 86.1, 129.7, 129.71; 403/354, 289, 290, 248

[56] References Cited

U.S. PATENT DOCUMENTS

| | | | |
|---|---|---|---|
| 346,995 | 8/1886 | Griswold | 242/107.15 |
| 1,569,577 | 1/1926 | Robinson | 242/100 X |
| 1,892,276 | 12/1932 | Johnson | 242/100 |
| 2,053,458 | 9/1936 | Black | 242/100 |
| 2,080,815 | 5/1937 | Gasstrom | 242/107.6 |
| 2,637,109 | 5/1953 | Willis | 242/107.11 X |
| 2,776,644 | 1/1957 | Fontaine | 242/99 |
| 2,832,943 | 4/1958 | Cutler | 403/289 X |
| 2,872,047 | 2/1959 | Ostlund | 242/100.1 X |
| 2,926,865 | 3/1960 | Humphreys | 242/107.13 |
| 2,989,267 | 6/1961 | Mehl | 242/107.13 X |
| 3,033,485 | 5/1962 | Shearer | 242/84.2 B |
| 3,039,716 | 6/1962 | Visockis | 242/84.2 B |
| 3,127,126 | 3/1964 | Hancock | 242/99 |
| 3,197,155 | 7/1965 | Chow | 242/107.1 |
| 3,311,319 | 3/1967 | Campbell | 242/100 |
| 3,719,378 | 3/1973 | Windsor | 403/354 X |
| 4,165,053 | 8/1979 | Konig | 242/107.1 |
| 4,272,036 | 6/1981 | Watermann | 242/96 |
| 4,470,558 | 9/1984 | Stamper | 242/100.1 X |

*Primary Examiner*—Stuart S. Levy
*Assistant Examiner*—Joseph J. Hail, III
*Attorney, Agent, or Firm*—Reising, Ethington, Barnard, Perry & Milton

[57] ABSTRACT

A retractable clothesline device (10) for storing a clothesline (12) when in a fully retracted position and enabling the clothesline (12) to be readily extended from its retracted position for use, the device (10) including an outer housing (14) and a spool (26) disposed within the housing (14) for retaining a clothesline (12) thereon. A spring is operatively connected to the spool (26) for being in a biased condition when the clothesline (12) is in an extended position and in a substantially unbiased condition relative to the biased condition when the clothesline (12) is in a fully retracted position. The device (10) includes an upper shelf (122) disposed directly over the spool (26) and a bottom shelf (124) disposed directly below the spool (26), the upper and bottom shelves (122,124) extending radially outwardly from the spool (26) substantially to the front wall (120) of the housing (14) to prevent the clothesline (12) from winding off of the spool (26) and into the housing (14).

6 Claims, 7 Drawing Figures

RETRACTABLE CLOTHESLINE DEVICE

This is a continuation of application Ser. No. 742,031, filed on June 6, 1985, now abandoned.

TECHNICAL FIELD

The subject matter of the present invention relates to a retractable clothesline device for storing the clothesline when in a fully retracted position and enabling the clothesline to be readily extended from its retracted position and secured in the position at which it is desired to be used.

BACKGROUND ART

Prior art clothesline devices provide a retractable clothesline or a plurality of retractable clotheslines which may be extended to a desired position and locked in place for use. The majority of these prior art devices utilize some form of a spool or reel to store the clothesline when in a retracted position. In one prior art device, five clotheslines are provided which are all stored upon a single large reel when the clotheslines are in their retracted positions. The main problem with this device is that the winding of five clotheslines around a single reel does not assure uniform storage and the clotheslines often become twisted together making it difficult to extend and retract them. In order to alleviate the problem of uniform winding other devices have provided spools with more than one storage area or have used more than one spool to receive different portions of a single clothesline. For example, in one prior art device, a single clothesline provides two lines for hanging clothes and when retracted into its dispenser is stored on two separate spools. The problem with the use of two separate spools is that differences between the biasing rates of the two spools can make it difficult to find a desired position, and further requires that each spool be independently locked.

Common biasing means in prior art devices include the use of a wound wire or flat metal spring between a shaft and the spool. When wound wire springs are used around a shaft at the core of the spool, they are difficult to replace when broken and usually force the disposal of the entire unit. Accordingly, the use of wound flat metal springs is preferred, but they have the disadvantage of often becoming bound up preventing the clothesline from being extended and retracted in a smooth, uniform manner.

The major problems encountered with prior art devices are that the cord has a tendency to wind off of the spool as the cord is quickly retracted into the device and secondly a great amount of spring is required to provide sufficient force to actuate the retracting of the clothesline. This invention provides an improvement over the prior art by providing structure within the housing of the device for maintaining the cord on the spool. Secondly, the invention provides a biasing spring requiring substantially less spring material to actuate the retraction of the clothesline.

SUMMARY OF THE INVENTION

The invention provides a retractable clothesline device for storing a clothesline in a fully retracted position and enabling the clothesline to be readily extended from its retracted position for use, the device including an outer housing and a spool rotatably mounted within the housing for retaining a clothesline thereon. Biasing means is operatively connected to the spool for being in a biased condition when the clothesline is in an extended position and in a substantially unbiased condition relative to the biased condition when the clothesline is in a fully retracted position. The device is characterized by including clothesline restricting means for restricting the clothesline from winding off of the spool within the housing.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
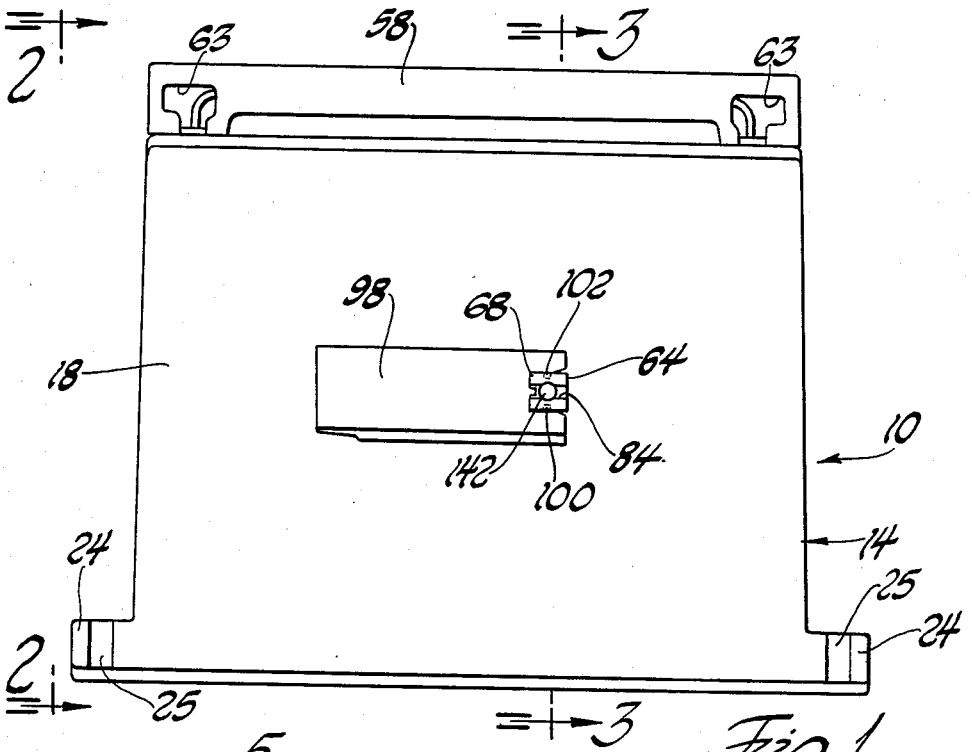
FIG. 1 is a side elevational view of an additional embodiment of the invention.
Figure 2:
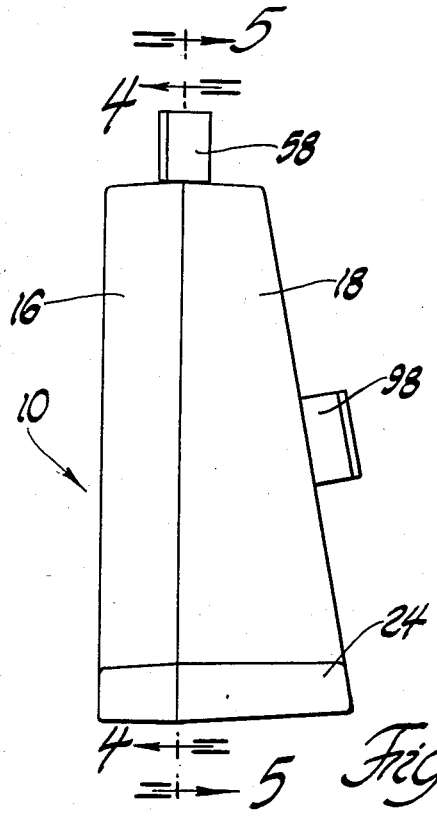
FIG. 2 is a side view taken substantially along lines 2—2 of FIG. 1.

With reference to the Figures, reference numeral 10 generally designates a retractable clothesline device for storing a clothesline 12 when a fully retracted position and enabling the clothesline to be readily extended from its retracted position for use. The device includes an outer housing, generally indicated at 14, having an upper portion 16 and a lower portion 18. The upper portion 16 and lower portion 18 are secured together by suitable connectors 20 and 22 or the perimeter of the portions 16,18 may be glued together. The housing 14 has a plurality of openings therethrough and includes a mounting bracket 24 for mounting the device on a rigid surface. The mounting bracket 24 preferably has tapered notches 25 so that the device 10 may be more easily mounted.

A spool is generally indicated at 26 and is rotatably mounted within the housing 14. The spool 26 has an upper radial flange 28 and a lower radial flange 32. The upper flange 28 and lower flange 32 have a plurality of circumferentially spaced openings 34 which provide a savings of material when the spools are manufactured. The spool 26 further includes a hub 44 with an opening 46 therethrough.

The clothesline 12 extends through openings in the housing 14 (not shown). The openings are preferably beveled to allow the clothesline to be more smoothly extended and retracted. The clothesline 12 is secured to the spool 26. A handle 58 is provided and is slidably disposed on the clothesline 12. The handle 58 includes open end channels 63 which extend through the handle. The clothesline 12 extends through the channels 63.

If due to differences in winding or for some other reason the handle 58 when extended provides lines of unequal length, the handle 58 may be slid along the clothesline 12 until two lines of equal length are obtained between the handle 58 and the housing 14. Alternatively, if the handle 58 is mounted, the clothesline 12 can be slid through the handle 58 to achieve lines of equal length.

Figure 5:
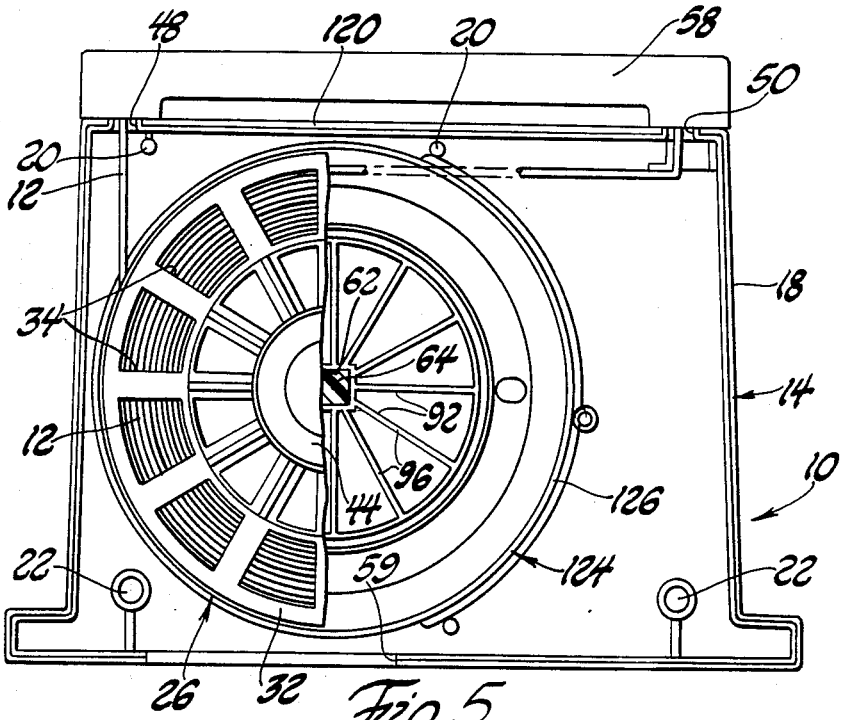
FIG. 5 is a cross sectional view taken substantially along lines 5—5 of FIG. 2.

An opening 59 is provided in the back of the housing 14, as shown in FIG. 5 for removing and replacing the clothesline 12.

The device further includes an integral spool bearing 60. The lower housing half 18 has an opening 62 extending centrally through the bearing 60. The spool bearing 60 is disposed between the spool 26 and the lower portion of the housing 12. The spool bearing 60 is integrally molded with the lower portion 18 of the housing 14.

A spindle 64 is further provided having an inner end 66 and an outer end 68. The spindle 64 extends through opening 46 in the hub and opening 62 in the spool bearing 60. The opening 62 in the spool bearing 60 also extends through the lower portion 18 of the housing 14. Therefore, the spindle 64 extends through the hub 44, the spool bearing 60 and the lower portion 18 of the housing 14. The opening 62 in the lower portion 18 of the housing 14 preferably defines a square. The portion of the spindle 64 which extends through opening 62 preferably has a square cross section thereby preventing the spindle 64 from rotating when inserted through the opening 62. The spindle 64 further includes an end portion 72 fixedly secured to the inner end 66 of the spindle 64. The end portion 72 has a frustoconical shape with the top of the frustum being secured to the inner end 66 of the spindle 64.

A spirally wound flat metal spring 74 is provided as the biasing means and is disposed within the central axial opening of the spool 26. The spring 74 has an outer end anchored to the spool 26 and an inner end secured to the spindle 64.

The spirally or helically wound spring 74 may have an induction heat treated portion comprising substantially the entire length of the wound spring. The inner end of the spring 74 would be annealed and bent off of the helix to be retained within the spool 26 and the spindle 64 respectively. The length of the spring would be heat treated at a higher Rockwell (approximately 87 to 88 Rockwell) to provide a substantial increase in torque on the spring as compared to prior art assemblies. Approximately 2 to 3 inches of each end of the spring 74 would be annealed to allow it to be bent off of the helix and inserted within the spool 26 and spindle 64. At this higher Rockwell, the spring 74 would be too hard to bend and therefore, the ends of the spring are annealed. Prior art assemblies would generally heat treat the spring to 75 Rockwell thereby allowing bending of the ends of the spring while having the metal sufficiently stiff to provide the spring action. By using the instant invention, a much shorter spring may be used to provide the torque of prior art springs. It has been found that 5 feet in length of the spring may be removed when treated in accordance with the instant invention and the spring will provide sufficient torque to actuate the spool to retract the extended clothesline.

A plurality of tapered circumferentially spaced axially extending ribs 92 are further provided and are secured to the hub 44 and the inner surface 38 of the spool 26. The ribs 92 have surfaces 96 tapering inwardly from the outer edge 40 of the spool 26 toward the opening 46 in the hub 44. The surfaces 96 define a frustoconical shape with the opening 46 in the hub 44 defining the top of the frustum. Openings (not shown) may be provided in the hub 44 between the axial ribs 92 to provide a savings of material if desired.

A clamping member 98 is pivotably attached to the outer end 68 of the spindle 64 and when in a clamped position exerts an axial force on the outer end 68 of the spindle 64 pulling the end portion 72 into frictional engagement with the surfaces 96 of the ribs 92 thereby securing the spool 26 in a fixed non-rotatable position relative to the spindle 64. The frustoconical shape of the end portion 72 is oriented and sized such that it mates and fits securely within the frustoconical shape defined by the surfaces 96 of the axial ribs 92 when the clamping member 98 is in its clamped position. While in the preferred embodiment the frustoconical shape with which the end portion 72 mates is defined by axial ribs 92, it is also possible to utilize a solid frustoconical shape on side of the hub 44. The use of the surfaces 96 of the ribs 92 reduces the surface area of frictional contact between the spool 26 and end portion 72, providing a greater unit pressure for securing the spool 26. The use of the ribs 92 has a further advantage of providing a savings in materials over the use of a solid frustoconical shape. When the clamping member 98 is in an open position, the end portion 72 is out of contact with the surface 96 of the ribs 92 thereby allowing the spool 26 to freely rotate within the housing 14.

The outer end 68 of the spindle 64 includes spherical notches 100 and 102 with the clamping member 98 having corresponding spherical nubs. The clamping member 98 further includes a notch 108 which fits into the central slot 84 of the spindle 64 when the clamping member is attached to the outer end 68 of the spindle 64. The clamping member 98 is attached to the outer end 68 of the spindle 64 by placing the clamping member in its assembly position such that nubs fits into notches 100 and 102. The clamping member 98 is rotated thereby compressing the outer end 68 of the spindle 64. The central slot 84 is outwardly tapered to assist in the insertion of the notch 108. Notch 108 creates an outward pressure preventing the outer end 68 of the spindle 64 from compressing thereby forcing notches 100 and 102 securely into the nubs. A tube member 142 is inserted into the slot 84 to prevent further compression of the outer end 68 of the spindle 64. Once the tube member 142 is inserted in the slot 84, the clamping member 98 is fixedly pivotally mounted on the outer end 68 of the spindle 64. The pressure between nubs and notches 100 and 102 secure the clamping member 98 to the outer end 68 of the spindle 64 as the clamping member 98 is pivoted between its clamped and unclamped positions.

Figure 7:
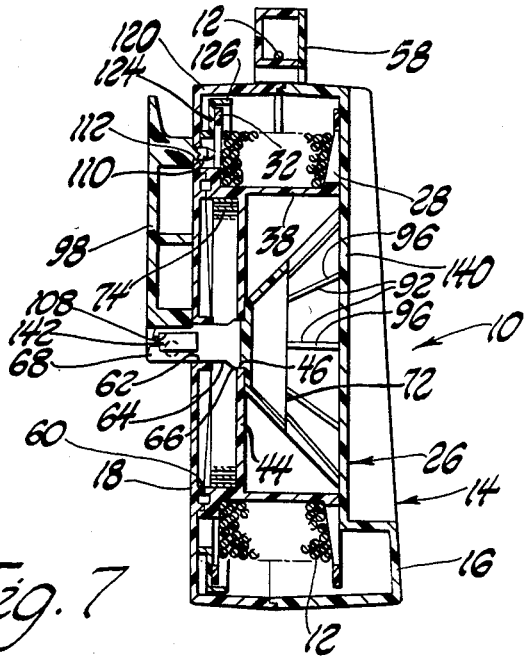
FIG. 7 is a cross sectional view taken along the lines 7—7 of FIG. 6.

As shown in FIG. 7, a pin 110 is provided which is fixedly secured to the clamping member 98. The pin 110 extends through an opening 112 in the lower portion 18 of the housing 14 and engages the spool 26 when the clamping member 98 is in its clamped position. The pin 110 acts as a secondary locking mechanism. If the frictional engagement of the end portion 72 with the surfaces 96 of the ribs 92 (e.g. the primary locking mechanism) for some reason fails to secure the spool in a fixed non-rotatable position relative to the spindle 64, or if the clamping member 98 is slightly moved from its clamped position, the pin 110 will prevent the spool 26 from rotating.

The assembly includes clothesline restricting mean disposed directly adjacent to said spool 26 for restricting the clothesline 12 from winding off of the spool 26 within the housing 14. More particularly, the housing 14 has a front wall 120 through which the clothesline 12 is extended and retracted. The clothesline restricting means includes a top shelf generally indicated at 122 disposed directly over the upper most flange 28 of the spool 26 and a bottom shelf generally indicated at 124 directly below the lower most of the flanges 32. The top and bottom shelves 122, 124 extend radially outwardly from the flanges 28 and 32, respectively, substantially to the front wall 120 to prevent the clothesline 12 from winding off of the spool 26 and into the housing 14. It has been found the the clothesline restricting means prevents binding of the assembly. Generally, the spring actuation of the spool 26 quickly winds the clothesline 12 into the housing 14. During this action in prior art assemblies, the clothesline had a tendency during this quick action to be wound off the spool and into the housing thereby binding the assembly. The clothesline restricting means of the instant invention retains the clothesline between the upper most and lower most flanges 28,32 of the spool 26 thereby preventing the clothesline 12 from winding off of the spool 26. The upper most and lower most flanges 28,32 are seated against the shelves 122,124.

The bottom shelf 124 of the clothesline restricting means comprises a retainer ring or spool ring 124 seated on the bottom wall of the housing 14. The spool ring 124 includes an annular rim 126 extending upwardly therefrom. The lower most flange 32 of the spool 26 is seated within the rim 126.

Figure 3:
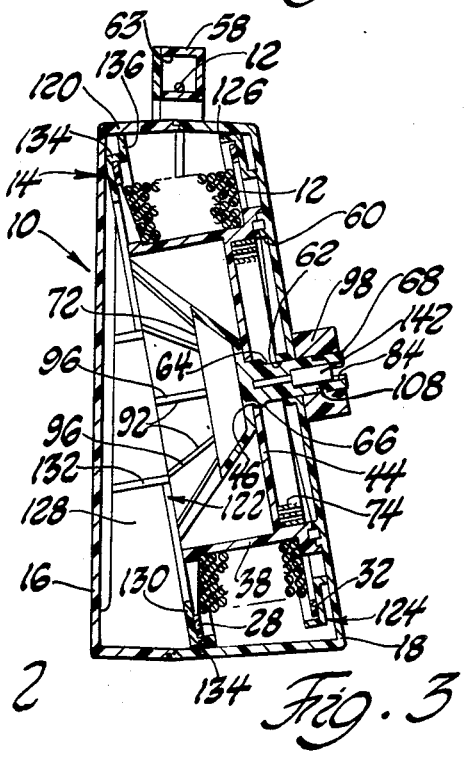
FIG. 3 is a cross sectional view taken substantially along lines 3—3 of FIG. 1.
Figure 4:
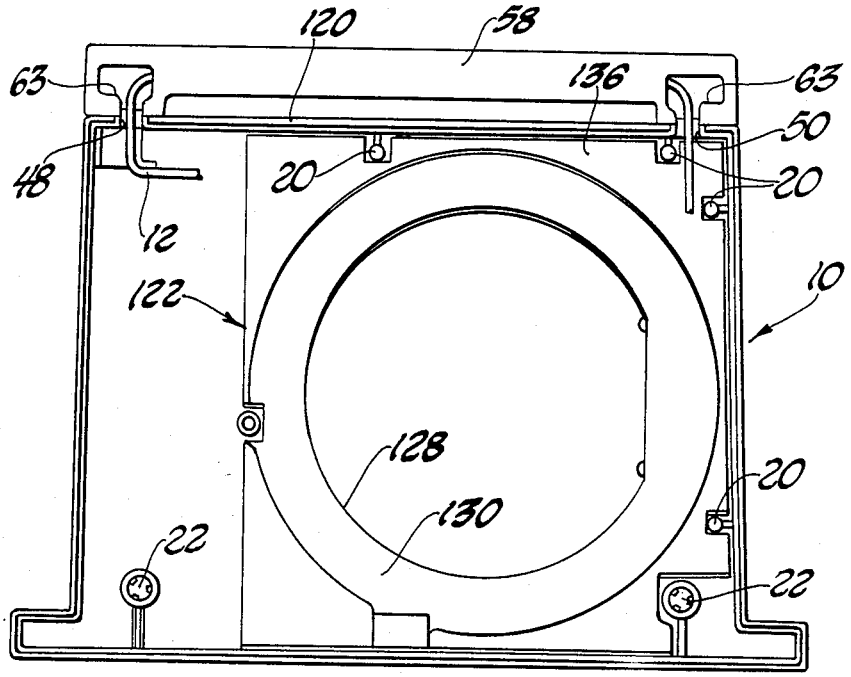
FIG. 4 is a cross sectional view taken substantially along lines 4—4 of FIG. 2.

One embodiment of the upper shelf 122 of the clothesline restricting means is shown in the FIGS. 3 through 5. The upper shelf 122 of the clothesline restricting means is shown to include an insert member 128 including a shelf portion 130 seated against the spool 26 and legs 132 extending therefrom engaging the upper wall of the housing 14. The spool 26 is seated between the insert member 128 and the spool ring 124 snugly within the housing 14. The shelf portion 130 of the insert member 128 includes a downwardly extending rim 134 about the periphery thereof, the spool 26 being seated within the rim 134. The rim 134 contributes to the stability of the spool 26 within the housing 14. The shelf portion 130 of the insert member 128 includes a flange 136 extending from the rim 134 to the front wall 120 of the housing 14. This flange 136 prevents the clothesline 12 from winding about the spool 26 outside of the upper flange 28 thereof.

Figure 6:
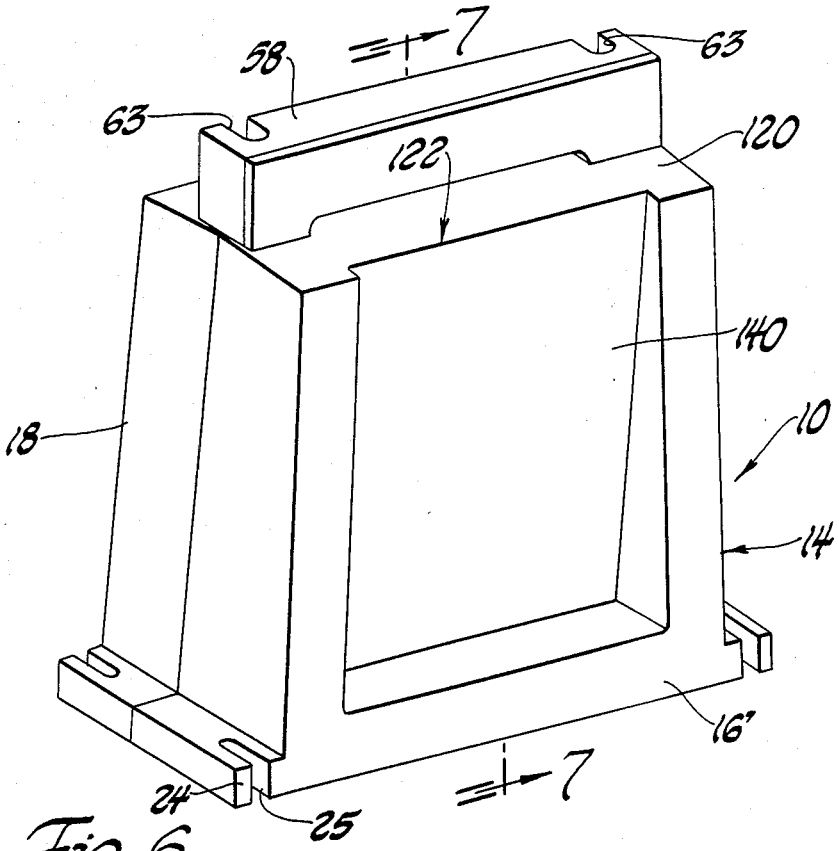
FIG. 6 is a perspective view showing an alternative embodiment of the upper housing half.

A second embodiment of the upper shelf 122 of the clothesline restricting means is shown in FIGS. 6 and 7. In this embodiment, the upper shelf 122 of the clothesline restricting means includes an indentation 140 in the upper wall of the housing 14 extending rearwardly from the front wall 120 of the housing 14. The indentation 140 has a surface within the housing 14 defining the upper shelf. As best shown in FIG. 7, the indentation 140 provides the upper shelf directly above the upper most flange 28 of the spool 26 to prevent the clothesline 12 from winding above the upper flange 28 and into the housing 10. The indentation 140 defines a shelf which engages the upper surface of the spool 26 thereby providing no room for entrance of the clothesline 12 into a portion of the housing 10 above the upper most flange 28 of the spool 26.

While in the preferred embodiment, the housing has a single spool with one clothesline which provides two lines for hanging clothes, it would be obvious to a person having ordinary skill in the art, that a larger housing can be provided using two or more spools in which four or more lines are provided for hanging clothes.

While a specific form of the invention is described in the foregoing specification and illustrated in the accompanying drawings, it should be understood that the invention is not limited to the exact construction shown. Alterations in the construction and arrangement of parts, all falling within the scope and spirit of the invention, will be apparent to those skilled in the art from the following claims.

What is claimed is:

1. A retractable clothesline device (10) for storing a clothesline (12) when in a fully retracted position and enabling the clothesline (12) to be readily extended from its retracted position for use, said device (10) comprising: an outer housing (14); a spool (26) rotatably mounted within said housing (14) for retaining a clothesline (12) thereon, said housing (14) having an interior space outside of said spool (26); biasing means (72) operatively connected to said spool (26) for being in a biased condition when the clothesline (12) is in an extended position and in a substantially unbiased condition relative to the biased condition when the clothesline (12) is in a fully retracted position; and characterized by clothesline restricting means directly adjacent said spool (26) for restricting said clothesline (12) from winding off of said spool within said interior space of said housing (14), said housing (14) having a front wall (120) through which said clothesline is extended and retracted and said spool (26) including upper and lower flanges (28,32), said clothesline restricting means including an upper shelf (122) disposed directly over said upper flange (28) and a bottom shelf (124) directly below said lower flange (32), said upper and bottom shelfs (122,124) extending radially outwardly from said flanges (28,32) substantially to said front wall (120) and said flanges (28,32) being seated directly against and in frictional engagement with said upper and bottom shelves (28,32) to prevent said clothesline (12) from winding off of said spool (26) and into said housing (14) said upper shelf (122) including a shelf portion (130) seated against said spool (26) and having a downwardly extending rim (134) about the periphery thereof, said spool (26) being seated within said rim (134), said housing (14) having an upper wall, said upper shelf (122) of said clothesline restricting means including an insert member (128) having said shelf portion (130) seated against said spool (26) and including legs (132) extending therefrom engaging said upper wall.

2. A device as in claim 1 wherein said housing (14) has a bottom wall, said bottom shelf (124) of clothesline restricting means including a retainer ring (124) seated on said bottom wall including an annular rim (126) extending upwardly therefrom, said lower flange (32) of said spool (26) being seated within said rim (126).

3. A device as in claim 2 wherein said housing (14) has an upper wall, said upper shelf (122) of said clothesline restricting means including an indentation (140) in said upper wall extending from said front wall (120), said indentation (140) having a surface within said housing (14) defining said upper shelf (122).

4. A device as in claim 1 wherein said shelf portion (130) of said insert member (128) includes a flange (136) extending from said rim (134) to said front wall (120).

5. A device as in claim 1 including a spindle (64) centrally supported within said outer housing (14) to rotate relative thereto, said biasing means including a helicaly wound spring (34) having an induction heat treated portion comprising substantially the entire length of said spring (74) and a first annealed end portion bent off of said helix and retained within said spindle (64).

6. A retractable clothesline device (10) for storing a clothesline (12) when in a fully retracted position and enabling the clothesline (12) to be readily extended from its retracted position for use, said device (10) comprising: an outer housing (14); a spool (26) rotatably mounted within said housing (14) for retaining a clothesline (12) therein, said housing (14) having an interior space outside of said spool (26); biasing means (72) operatively connected to said spool (26) for being in a biased condition when the clothesline (12) is in an extended position and in a substantially unbiased condition relative to the biased condition when the clothesline (12) is in a fully retracted position; and characterized by clothesline restricting means directly adjacent said spool (26) for restricting said clothesline (12) from winding off of said spool within said interior space of said housing (14), said housing (14) having a front wall (120) through which said clothesline is extended and retracted and said spool (26) including upper and lower flanges (28,32), said clothesline restricting means including an upper shelf (122) disposed directly over said upper flange (28) and a bottom shelf (124) directly below said lower flange (32), said upper and bottom shelves (122,124) extending radially outwardly from said flanges (28,32) substantially to said front wall (120) to prevent said clothesline (12) from winding off of said spool (26) and into said housing (14) said device including a spindle (64) extending through said spool (26) and including an outer end (68) having a central slot (84), said device (10) including a clamping member (98) grasping the exterior surface of said outer end (68) and being pivotally mounted thereon, said device (10) including compression resisting means for resisting compression of said outer end (68) at said central slot (84) to retain said clamping member (98) upon said end (68), said compression resisting means includes a tube member (142) disposed within said central slot (84).

* * * * *